US006276099B1

(12) United States Patent
O'Shea

(10) Patent No.: US 6,276,099 B1
(45) Date of Patent: Aug. 21, 2001

(54) WINDOW FRAME ASSEMBLY

(76) Inventor: Darin L. O'Shea, 9314 Ridge Rd., Middleport, NY (US) 14105

( * ) Notice: Subject to any disclaimer, the term of this patent is extended or adjusted under 35 U.S.C. 154(b) by 369 days.

(21) Appl. No.: 08/787,700

(22) Filed: Jan. 28, 1997

(51) Int. Cl.[7] ..... E06B 1/04
(52) U.S. Cl. ..... 52/204.1; 52/204.52; 52/209; 52/656.2
(58) Field of Search ..... 52/204.1, 204.52, 52/209, 302.7, 656.2, 656.5

(56) References Cited

U.S. PATENT DOCUMENTS 3,314,201 * 4/1967 Riegelman ..... 52/209
3,849,938 * 11/1974 Thompson ..... 52/209 X
3,903,650 * 9/1975 Anderson ..... 52/209 X
4,050,201 * 9/1977 Hubbard et al. ..... 52/209 X
4,228,630 * 10/1980 Englert et al. ..... 52/204.1 X
5,044,121 * 9/1991 Harbom et al. ..... 52/209 X
5,086,596 * 2/1992 Schlyper et al. ..... 52/204.52
5,303,522 * 4/1994 Vagedes ..... 52/209 X
5,651,223 * 7/1997 Novak et al. ..... 52/204.1 X
5,664,375 * 9/1997 Ward ..... 52/97

OTHER PUBLICATIONS

Simonton Windows brochue for ProFinish (line of new construction vinyl windows; 1996).

* cited by examiner

*Primary Examiner*—Carl D. Friedman
*Assistant Examiner*—Brain E. Glessner
(74) *Attorney, Agent, or Firm*—Simpson, Simpson & Snyder, L.L.P.

(57) ABSTRACT

A window frame assembly comprising a window frame and a J-channel member integral with the window frame, the J-channel member containing integral drains operatively arranged to constrain and divert water away from the window frame.

12 Claims, 5 Drawing Sheets

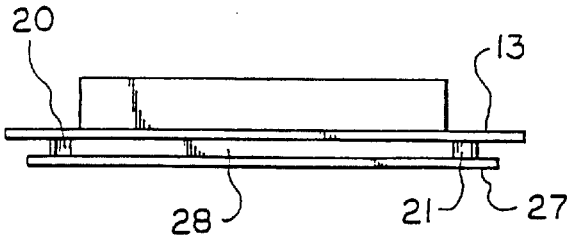
FIG. 6
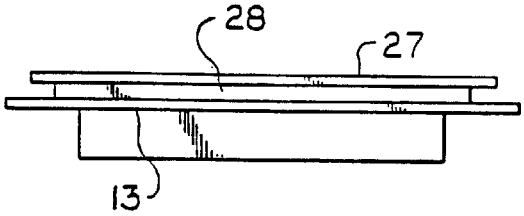
FIG. 7
FIG. 9A
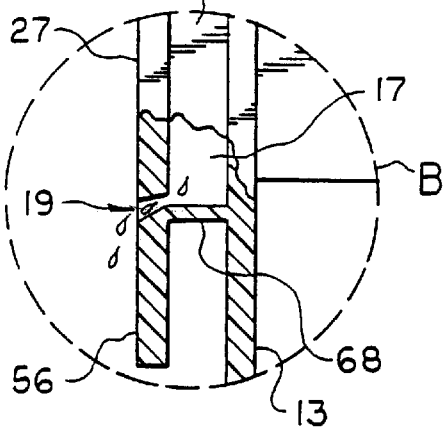
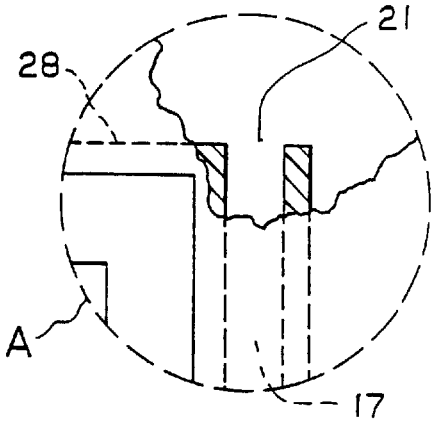
FIG. 8
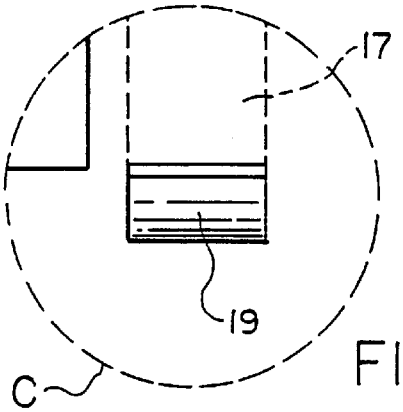
FIG. 10
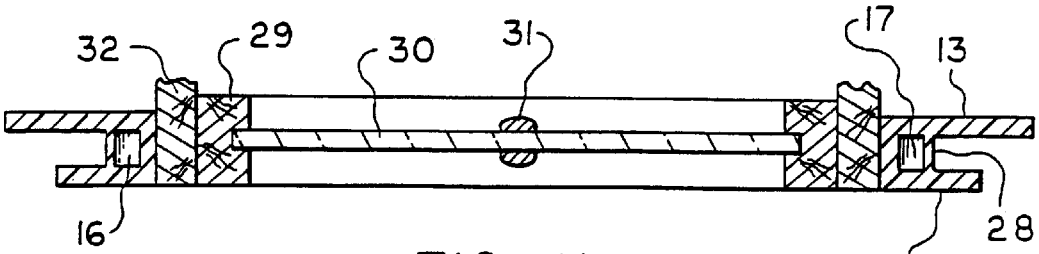
FIG. 11

FIG. 9B
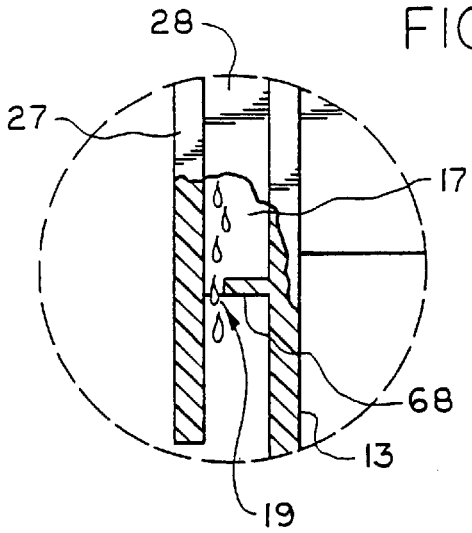
FIG. 15B
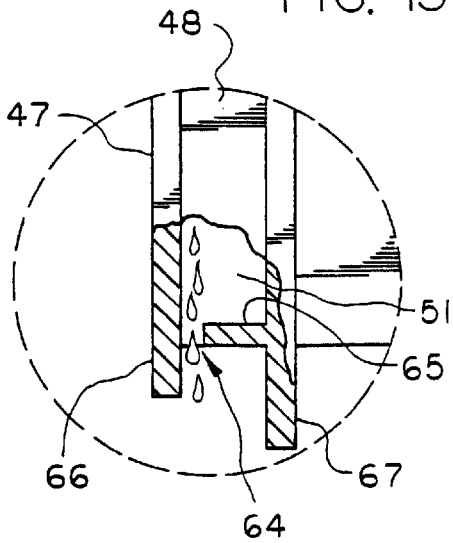
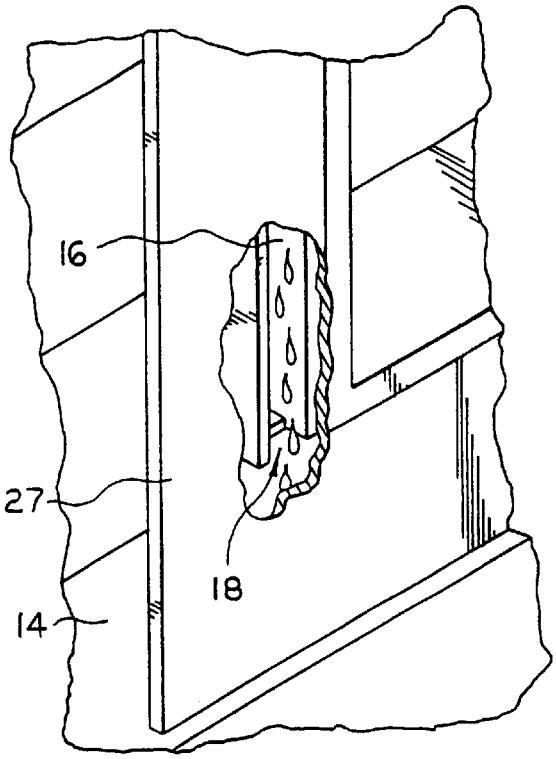
FIG. 17

FIG. 12
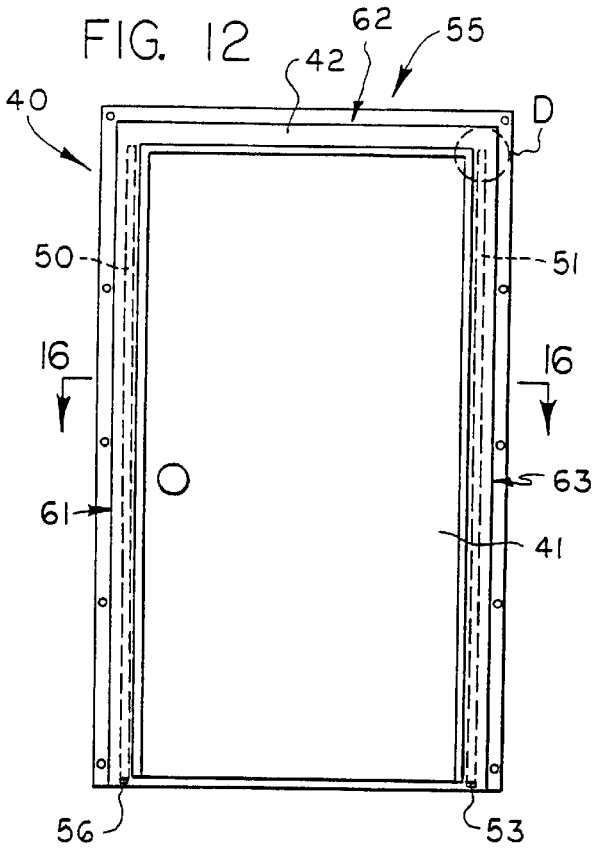
FIG. 13
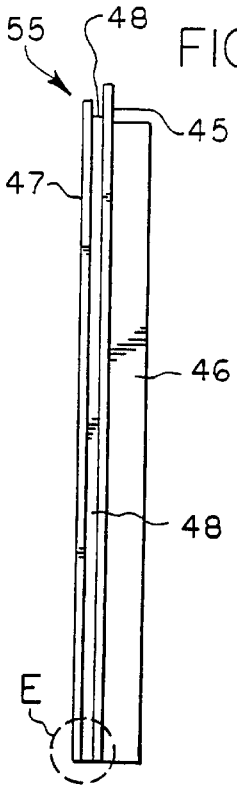
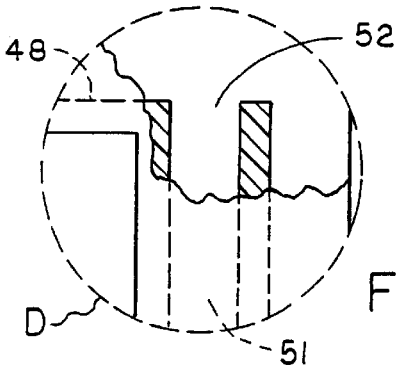
FIG. 14
FIG. 15A
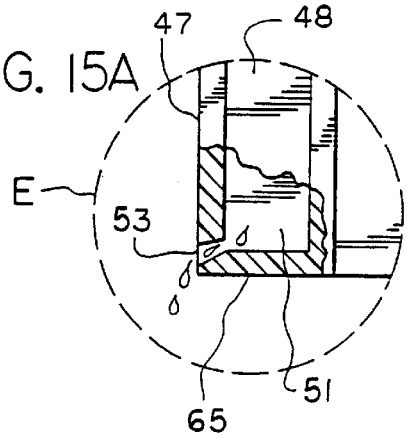
FIG. 16
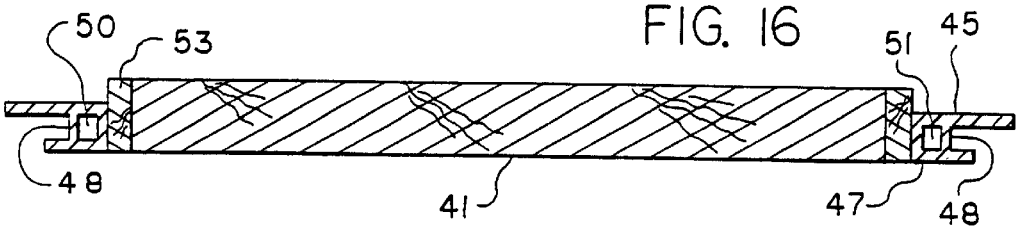

WINDOW FRAME ASSEMBLY

BACKGROUND OF THE INVENTION

This invention relates generally to window frames, and, more particularly, to an improved window frame assembly having integral J-channel which contains integral drains.

A problem with many window and door frame assemblies, and with aluminum and vinyl siding which border these frame assemblies, is that they permit water to drain behind the siding itself, creating damage to the house or other structure. Typically, a window or door frame is mounted within an opening in a structure and then vinyl or aluminum siding is secured about the frame. It is common in the industry to mount J-channel about the periphery of the window frame and onto the underlying structure and then to secure the siding directly to the J-channel. Unfortunately, present J-channel construction, in combination with the way the siding is mounted, permits water to travel behind the siding, causing structural damage.

One attempt to solve this problem has been made by Simonton Building Products, Inc. who recently introduced a "Profinish" line of windows containing integral J-channel on the window frame. While this product is certainly an improvement, the J-channel merely functions to channel rainwater from the top of the window frame to the sides, still permitting the water to infiltrate the area behind the siding.

What is needed, then, is a window frame assembly which provides a means for rainwater to drain safely away from the underlying structure to prevent water damage.

SUMMARY OF THE INVENTION

The invention provides a window frame assembly comprising a window frame and a J-channel member integral with the window frame, the J-channel member containing integral drains operatively arranged to constrain and divert water away from the window frame. The J-channel member comprises four sections which surround the window frame: an upper window jamb section, a lower window sill section, a first vertical section, and a second vertical section. The J-channel itself comprises an interior nailing flange, and exterior flange and a bridge member. The bridge member in the upper window jamb section contains openings to drain channels which run vertically downward inside and adjacent the bridge members of the vertical sections. The drain channels receive rainwater from the upper window jamb section and expel the water from the bottom of the window and along the exterior surface of siding or other structure covering.

The invention is not limited to a window frame assembly, but also pertains to any opening in a structure, such as a door, air conditioner opening, electrical junction box opening, or the like.

The primary object of the invention is to provide a frame assembly for an opening in a structure which provides a means of draining water from the assembly and preventing water from causing damage to the structure.

These and other objects, features and advantages of the invention will become readily apparent to one having ordinary skill in the art from the following description of the invention, attached drawings, and appended claims.

BRIEF DESCRIPTION OF THE DRAWINGS

FIG. 6 is a top view of the window frame assembly shown in FIG. 2;

FIG. 7 is a top view of the window frame assembly shown in FIG. 4;

FIG. 8 is an enlarged fragmentary view of the top of the J-channel section of the window frame assembly shown in Section A in FIG. 2;

FIG. 9A is an enlarged fragmentary view of the bottom of the J-channel section of the window frame assembly shown in Section B in FIG. 3;

FIG. 9B is a view similar to that of FIG. 9A showing an alternative embodiment of the bottom of the J-channel section of the window frame assembly shown in Section B in FIG. 3;

FIG. 10 is an enlarged view of Section C in FIG. 2, showing one of the drains of the window frame assembly;

FIG. 11 is a cross-sectional view taken along plane 11—11 in FIG. 2;

FIG. 12 is an exterior elevation view of the door frame assembly of the invention installed in a structure;

FIG. 13 is a side view of the door frame assembly shown in FIG. 12;

FIG. 14 is an enlarged fragmentary view of Section D of the door frame assembly shown in FIG. 12;

FIG. 15A is an enlarged fragmentary view of Section E of the door frame assembly shown in FIG. 13;

FIG. 15B is a view similar to that of FIG. 15A showing an alternative embodiment of Section E of the door frame assembly shown in FIG. 13;

FIG. 16 is a cross-sectional view of the door frame assembly taken along plane 16–16 in FIG. 12;

FIG. 17 is a fragmentary exterior elevation view of an alternative embodiment of the lower left window frame assembly shown in FIG. 1.

DESCRIPTION OF THE PREFERRED EMBODIMENT

Figure 1:
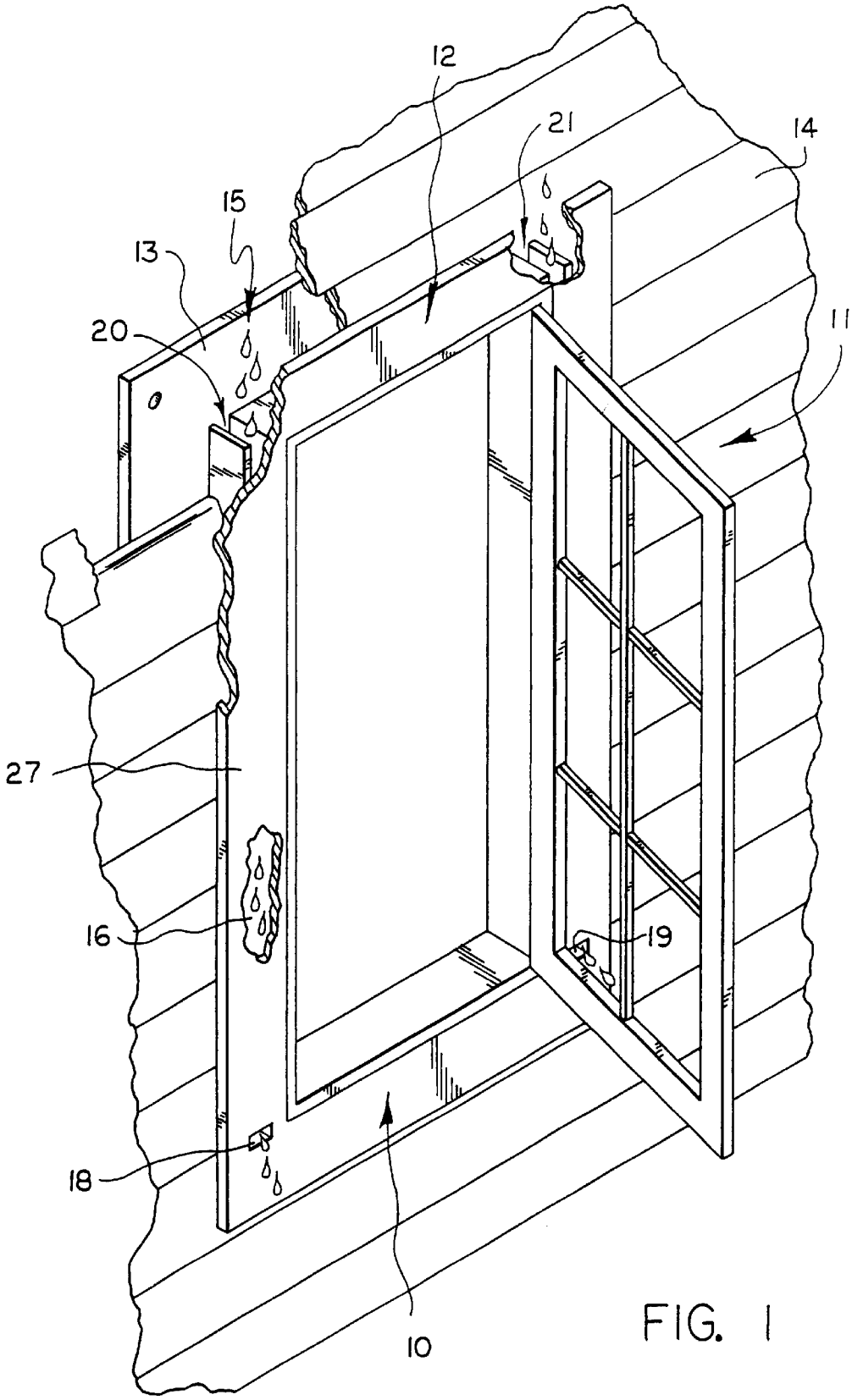
FIG. 1 is a fragmentary exterior elevation view of the window frame assembly of the invention installed in a structure.

At the outset, it should be clearly understood that the drawings are to be read together with the specification, and are to be considered a portion of the entire "written description" of this invention, as required by 35 U.S.C. § 112. Also, identical reference numerals on different figures refer to identical elements of the invention. It should also be understood that the word "window" is intended to mean any opening within a structure, including but not limited to a door opening, vent, air conditioner opening, electric meter box, light fixture, chimney, electrical receptacle, or the like.

Adverting now to the drawings, FIG. 1 is a fragmentary exterior elevation view of the window frame assembly 10 of the invention installed in a structure 11, such as a house. In this embodiment the house is covered with vinyl siding 14. Window frame assembly 10 broadly comprises J-channel member 12 integral therewith. The J-channel includes nailing flange 13, exterior flange 27, and bridge member 28 (shown in FIG. 3) connecting the flanges together. The nailing flange is used to mount the window frame assembly to the house and also functions as a base upon which the vinyl siding is secured proximate the window. The J-channel member is arranged about the periphery of the window frame assembly, and it is seen that siding 14 is "sandwiched" between the nailing flange and the exterior flange. An obvious problem with prior art window assemblies is that rain water (illustrated by drops 15) is permitted to flow behind the vinyl siding, thereby causing structural damage. The present invention provides drain channels within the J-channel on each vertical side of the window to drain water along the outside surface of the siding, preventing flow behind the siding. This feature of the invention will be described in more detail infra.

Figure 2:
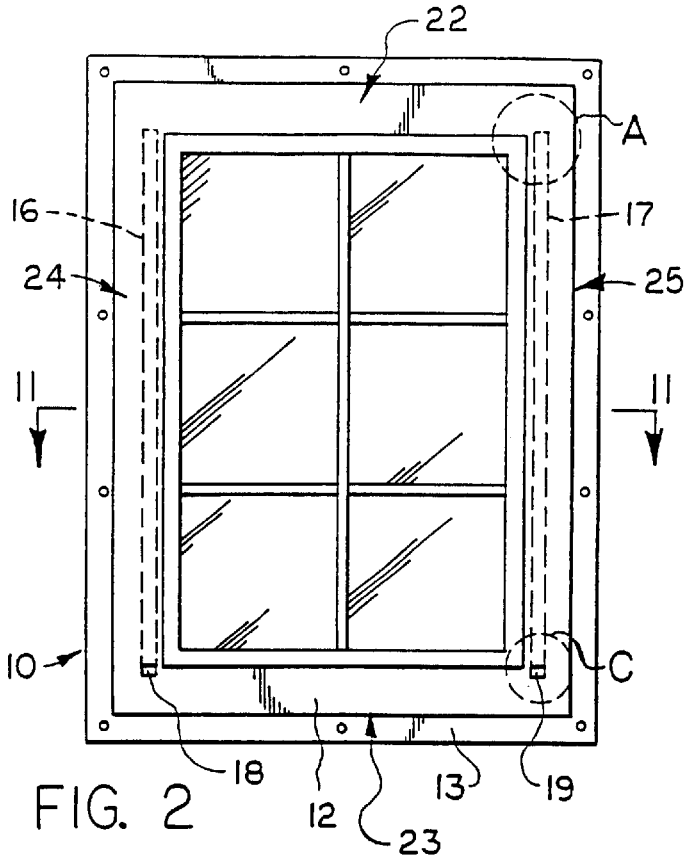
FIG. 2 is a front view of the window frame assembly shown in FIG. 1, isolated from the structure.

FIG. 2 is a front view of the window frame assembly shown in FIG. 1, isolated from the structure. J-channel 12 comprises four sections: upper window jamb section 22, lower window sill section 23, first vertical section 24, and second vertical section 25. Shown in phantom in FIG. 2 are drain channels 16 and 17, respectively, which are integral to the J-channel member. Rain water enters the channels at openings 20 and 21, respectively (shown in FIG. 1), and leaves the channels at openings 18 and 19, respectively. In this particular embodiments, openings 18 and 19 provide an outlet to the front of J-channel member 12. In an alternative embodiment shown in FIG. 17, the openings outlet to the rear of the J-channel member, and the water flows down the exterior surface of the vinyl siding. This is perhaps a more aesthetically pleasing outlet structure, as the water flow is not plainly visible.

Figure 3:
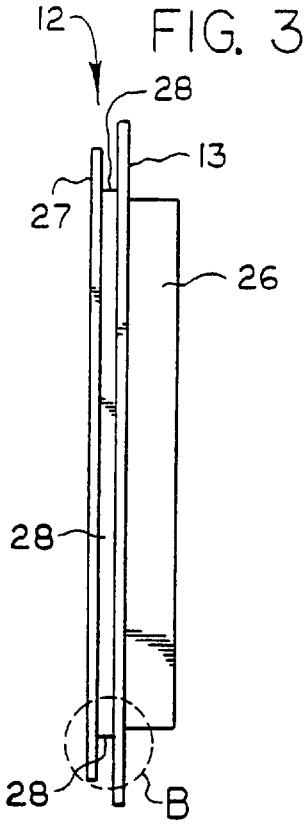
FIG. 3 is a side view of the window frame assembly shown in FIG. 2.

FIG. 3 is a side view of the window frame assembly shown in FIG. 2. As shown in this view, J-channel member 12 comprises nailing flange 13, exterior flange 27 and bridge member 28 which joins the flanges together. The flanges and the bridge member extend about the periphery of the window frame assembly. Exterior flange 27 functions to constrain rain water on the bridge section between the two flanges. On the upper window jamb section, the water is directed into inlets 20 and 21. Also shown in FIG. 3 is frame member 26 which is secured inside the opening in the structure.

Figure 4:
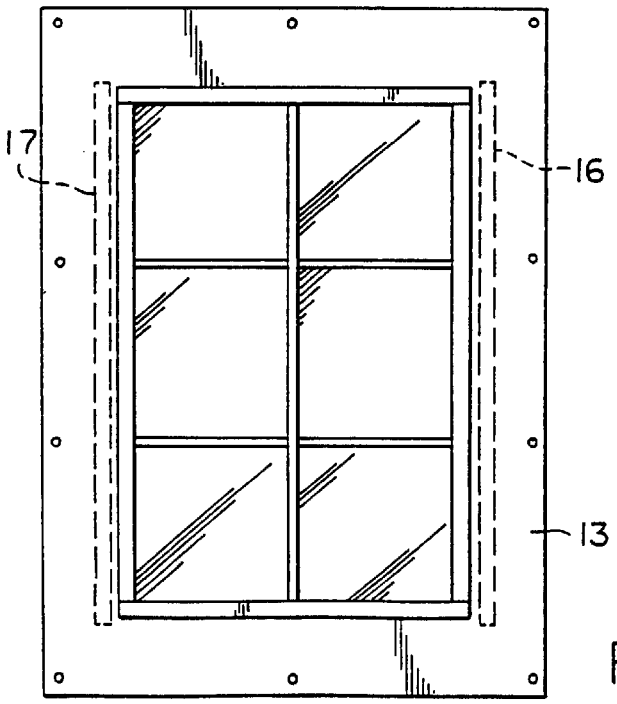
FIG. 4 is a rear view of the window frame assembly shown in FIG. 1, isolated from the structure.
Figure 5:
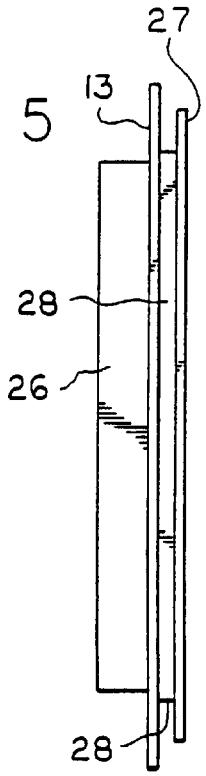
FIG. 5 is a side view of the window frame assembly shown in FIG. 4.

FIG. 4 is a rear view of the window frame assembly shown in FIG. 1, isolated from the structure, and FIG. 5 is a side view of the assembly shown in FIG. 4.

FIG. 6 is a top view of the window frame assembly shown in FIG. 2 and FIG. 7 is a bottom view of the window frame assembly shown in FIG. 4. As shown in FIG. 6, bridge member 28 in the upper jamb section includes drain inlets 20 and 21. Rain water which collects on the upper window jamb section flows into these openings and into their respective drain channels. Inlet 20 allows water to flow into drain channel 16 and inlet 21 allows water to flow into drain channel 17 (shown in phantom in FIGS. 2 and 4).

Inlet 21 to drain channel 17 is shown in detail in fragmentary cross-sectional view in FIG. 8, which is an enlarged view of Section A of the assembly shown in FIG. 3. As described previously, rain water collects on the surface of bridge member 28 and flows into the drain inlets.

Outlet 19 of drain channel 17 is shown in more detail in fragmentary cross-sectional view in FIG. 9A, which is an enlarged view of Section B of the assembly shown in FIG. 3. Water travels downwardly through channel 17 and is expelled via outlet 19 to the front of the window frame assembly. As shown in FIG. 9A, water in channel 17 is directed to the bottom 68 of channel 17. Outlet 19 is formed in flange 27 and flange extension 56. FIG. 9B illustrates an alternative embodiment in which outlet 19 releases water "behind" flange 27. In this embodiment, outlet 19 is formed by flange 27 and bottom floor 68. The expelled water in this embodiment flows down the exterior surface of the vinyl siding.

Outlet 19 is also shown in detail in FIG. 10 which is an enlarged view of Section C shown in FIG. 2.

FIG. 11 is a cross-sectional view taken along plane 11—11 in FIG. 2. In addition to the structural elements of the invention previously described, FIG. 11 also shows window pane 30 secured to casement 29, window jamb 32, and mullion 31.

The present invention may take the form of several embodiments. Described thus far is the window frame assembly embodiment. It should be readily apparent to one having ordinary skill in the art, however, that the invention may take the form of a door frame embodiment as illustrated in FIGS. 12–16, and may also find application in any opening in a dwelling or building structure, such as vents, air conditioners, electric meter boxes, lights, chimneys, and the like.

Adverting now to FIG. 12, door frame assembly 40 is illustrated in an exterior elevation view. Door 41 is shown encased by frame 42 which comprises the invention. J-channel 55 comprises nailing flange 45, exterior flange 47 and bridge member 48. The J-channel comprises first vertical section 61, upper door jamb section 62, and second vertical section 63. Vertical sections 62 and 63 contain drains 50 and 51, respectively, shown in phantom, which drain rainwater from the bridge member 48 of the J-channel. As shown in the drawing, drain channels 50 and 51 dispel water from outlets 56 and 53, respectively.

FIG. 13 is a side view of the frame assembly shown in FIG. 12. The frame assembly includes J-channel 55, nailing flange 45 and frame member 46 which would be mounted inside the opening in the structure. The J-channel member is shown as having exterior flange 47, bridge member 48 and nailing flange 45. A difference between the window frame embodiment and the door frame embodiment is illustrated in FIG. 15A, which is an enlarged fragmentary view of section E of the assembly shown in FIG. 13. Comparing FIG. 15A with FIG. 9A, it is seen that the J-channel assembly shown in FIG. 9A includes drip extension piece 56, whereas the assembly shown in FIG. 15A has no such extension. As shown in FIG. 15A, outlet 53 expels water from drain channel 51 from floor 65 of drain 51. This expelled water would land on the bottom door sill and then travel to the door stoop. FIG. 9B illustrates an alternative embodiment of the drain. In this embodiment, outlet 64 is formed by extension 66 of flange 47 and floor 65 of drain 51. This embodiment would permit water to drain into a door channel beneath the door frame, as opposed to allowing the water to flow across the door sill and door stoop.

Right inlet 52 is shown in enlarged fragmentary view in FIG. 14, which is an enlargement of section D of FIG. 12. This inlet permits rain water to exit bridge 48 into drain channel 51. A corresponding left inlet (not shown) permits water to exit bridge 48 into drain channel 50.

Finally, FIG. 16 is a cross-sectional view taken along plane 16–16 in FIG. 12. In addition to the structural elements of the invention previously described, FIG. 16 also shows doorjamb 53.

Thus, it is seen that the invention effectively achieves its purposes of providing an improved window frame assembly which eliminates a potential water damage problem by channeling and draining rain water through the window frame assembly. It will be understood that the foregoing description is illustrative of the invention and should not be considered as limiting and that other embodiments of the invention are possible without departing from the invention's spirit and scope, as embodied in the following claims.

What is claimed is:

1. A window frame assembly, comprising:

a window frame; and, a J-channel member integral with said window frame, said J-channel member containing integral drains operatively arranged to constrain and divert water away from and exterior to said window frame, said drains comprising enclosed channels having an inlet to receive rain water and an outlet to expel said rain water exterior to said window frame.

2. A window frame assembly as recited in claim 1 wherein said J-channel member comprises a nailing flange, an exterior flange and a bridge member connecting said flanges.

3. A window frame assembly as recited in claim 2 wherein said J-channel comprises four sections: an upper window jamb section, a lower window sill section, a first vertical section, and a second vertical section, wherein each of said four sections comprises said nailing flange, said exterior flange, and said bridge member connecting said flanges.

4. A window frame assembly as recited in claim 3 wherein said first vertical section and said second vertical section each contain said enclosed drain channels, said bridge member of said upper window jamb section contains said inlets to said enclosed drain channels, and said enclosed drain channels direct water away from and exterior to said window frame.

5. A window frame assembly as recited in claim 2 wherein said nailing flange is used to secure said J-channel to a structure and also provides a flat surface for mounting of siding.

6. a window frame assembly as recited in claim 2 wherein said exterior flange functions to constrain water between said nailing flange and said exterior flange.

7. A door frame assembly, comprising:

a door frame; and, a J-channel member integral with said door frame, said J-channel member containing integral drains operatively arranged to constrain and divert water away from and exterior to said door frame, said drains comprising enclosed channels having an inlet to receive rain water and an outlet to expel said rain water exterior to said door frame.

8. A door frame assembly as recited in claim 7 wherein said J-channel member comprises a nailing flange, an exterior flange and a bridge member connecting said flanges.

9. A door frame assembly as recited in claim 8 wherein said J-channel comprises three sections: an upper door jamb section, a first vertical section, and a second vertical section, wherein each of said three sections comprises said nailing flange, said exterior flange, and said bridge member connecting said flanges.

10. A door frame assembly as recited in claim 9 wherein said first vertical section and said second vertical section each contain said enclosed drain channels, said bridge member of said upper door jamb section contains said inlets to said enclosed drain channels, and said enclosed drain channels direct water away from and exterior to said door frame.

11. A door frame assembly as recited in claim 9 wherein said nailing flange is used to secure said J-channel to a structure and also provides a flat surface for mounting of siding.

12. A door frame assembly as recited in claim 9 wherein said exterior flange functions to constrain water between said nailing flange and said exterior flange.

* * * * *